US010364950B2

(12) United States Patent
Pikman

(10) Patent No.: US 10,364,950 B2
(45) Date of Patent: Jul. 30, 2019

(54) BARRIER GATE ARM WITH RECESSED LIGHT HOUSING

(71) Applicant: Michael Pikman, Coconut Creek, FL (US)

(72) Inventor: Michael Pikman, Coconut Creek, FL (US)

( * ) Notice: Subject to any disclaimer, the term of this patent is extended or adjusted under 35 U.S.C. 154(b) by 0 days.

(21) Appl. No.: 15/889,195

(22) Filed: Feb. 5, 2018

(65) Prior Publication Data

US 2018/0156398 A1 Jun. 7, 2018

Related U.S. Application Data

(63) Continuation-in-part of application No. 15/424,782, filed on Feb. 4, 2017, now abandoned.

(60) Provisional application No. 62/337,482, filed on May 17, 2016.

(51) Int. Cl.

| | |
|---|---|
| ***F21S 8/02*** | (2006.01) |
| ***E01F 13/06*** | (2006.01) |
| ***B61L 29/04*** | (2006.01) |
| ***F21V 33/00*** | (2006.01) |
| *F21S 4/20* | (2016.01) |
| *F21Y 103/10* | (2016.01) |
| *F21W 111/02* | (2006.01) |
| *F21Y 115/10* | (2016.01) |

(52) U.S. Cl.

CPC ..... *F21S 8/02* (2013.01); *B61L 29/04* (2013.01); *E01F 13/06* (2013.01); *F21V 33/006* (2013.01); *B61L 2207/02* (2013.01); *F21S 4/20* (2016.01); *F21W 2111/02* (2013.01); *F21Y 2103/10* (2016.08); *F21Y 2115/10* (2016.08)

(58) Field of Classification Search

CPC ..... F21S 44/20; F21S 8/02; E01F 13/06

See application file for complete search history.

(56) References Cited

U.S. PATENT DOCUMENTS

| | | | |
|---|---|---|---|
| 2,676,425 | A | 4/1954 | Bonanno |
| 3,544,782 | A | 12/1970 | Hahn |
| 3,863,251 | A | 1/1975 | Gould et al. |
| 3,994,457 | A | 11/1976 | Teasel |
| 4,463,962 | A | 8/1984 | Snyder |

(Continued)

FOREIGN PATENT DOCUMENTS

| | | | |
|---|---|---|---|
| GB | WO2012004595 | A1 | 1/2012 |
| IT | WO2013093602 | A2 | 6/2013 |
| WO | WO2007030542 | A3 | 3/2007 |

*Primary Examiner* — Gregory J Strimbu

(74) *Attorney, Agent, or Firm* — Allen F. Bennett; Bennett Intellectual Property

(57) ABSTRACT

A vehicle barrier gate arm is pivotable upward and downward. The gate arm has an exterior wall having at least one channel extending along the length of the gate arm. The channel includes a recessed light housing containing a light system such as an LED light strip or a light rope. The channel is defined by two opposing, parallel channel walls and a backwall. Each channel wall has a retaining fin extending perpendicularly therefrom into the channel, thereby forming an aperture for the light housing. The light housing is situated between the retaining fins and the backwall. A visor channel extends from the retaining fins to the exterior wall of the gate arm. The visor channel provides a stronger contrast between illuminated and non-illuminated light systems within the light housing, allowing an observer to better determine whether the LED lights strips, which often act as signals, are activated or are not activated.

5 Claims, 2 Drawing Sheets

(56) References Cited

U.S. PATENT DOCUMENTS

| | | | |
|---|---|---|---|
| 4,535,331 | A | 8/1985 | Koenig |
| 5,430,627 | A | 7/1995 | Nagano |
| 5,690,421 | A | 11/1997 | Shea et al. |
| 5,775,016 | A | 7/1998 | Chien |
| 5,848,837 | A | 12/1998 | Gustafson |
| 6,472,823 | B2 | 10/2002 | Yen |
| 6,487,818 | B1 | 12/2002 | Hamann et al. |
| 6,612,717 | B2 | 9/2003 | Yen |
| 6,659,623 | B2 | 12/2003 | Friend |
| 6,673,292 | B1 | 1/2004 | Gustafson et al. |
| 6,883,931 | B2 | 4/2005 | Tufte |
| 6,997,417 | B2 | 2/2006 | Zarkades |
| 7,258,461 | B1 | 8/2007 | Izardel |
| 7,258,467 | B2 | 8/2007 | Saccomanno et al. |
| 7,267,461 | B2 | 9/2007 | Kan et al. |
| 7,347,606 | B1 | 3/2008 | Patten |
| 7,401,949 | B2 | 7/2008 | Tufte |
| 7,862,203 | B2 | 1/2011 | Tu et al. |
| 8,011,797 | B2 | 9/2011 | Rihl |
| 8,104,920 | B2 | 1/2012 | Dubord |
| 8,115,411 | B2 | 2/2012 | Shan |
| 8,305,225 | B2 | 11/2012 | Hefright et al. |
| 8,764,220 | B2 | 7/2014 | Chan et al. |
| 8,845,125 | B1 | 9/2014 | Lumsden et al. |
| 9,228,708 | B2 | 1/2016 | Dings et al. |
| 9,273,435 | B2 | 3/2016 | Lumsden et al. |
| 2003/0048641 | A1 | 3/2003 | Alexanderson et al. |
| 2003/0210546 | A1 | 11/2003 | Chin |
| 2005/0007033 | A1 | 1/2005 | Kan et al. |
| 2005/0044703 | A1 | 3/2005 | Liu et al. |
| 2007/0199243 | A1 | 8/2007 | Youn |
| 2008/0094824 | A1 | 4/2008 | Stack et al. |
| 2008/0136661 | A1 | 6/2008 | Pederson et al. |
| 2008/0240854 | A1 | 10/2008 | Binns |
| 2008/0304253 | A1 | 12/2008 | Handsaker |
| 2009/0244889 | A1 | 10/2009 | Rihl |
| 2010/0008090 | A1 | 1/2010 | Li et al. |
| 2010/0091494 | A1 | 4/2010 | Pearson et al. |
| 2011/0272652 | A1 | 11/2011 | Scopes et al. |
| 2013/0235558 | A1 | 9/2013 | Zhou |
| 2016/0033117 | A1 | 2/2016 | Grigore |

BARRIER GATE ARM WITH RECESSED LIGHT HOUSING

CROSS-REFERENCE TO RELATED APPLICATIONS

This application is a continuation-in-part of U.S. Utility application Ser. No. 15/424,782 filed on Feb. 4, 2017, now abandoned, and claims priority to U.S. Provisional Application Ser. No. 62/337,482 filed on May 17, 2016, the contents of which are hereby incorporated by reference in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

INCORPORATION-BY-REFERENCE OF THE MATERIAL SUBMITTED ON A COMPACT DISC

Not Applicable.

BACKGROUND OF THE INVENTION

Field of the Invention

The present invention relates to a gate arm having recessed lighting. More particularly, the invention relates to barrier gate arms illuminated by lighting systems located in recessed channels that minimize sunlight reflection.

Description of the Related Art

Movable barriers, such as pivoting gate arms, have long been used to control access to parking lots, parking decks, residential subdivisions and other areas. Typically, a barrier includes a gate arm supported by a gate arm housing on one side of a pathway such as a vehicle roadway and extending across substantially all of the pathway. These barrier gate arms may pivot upward, pivot horizontally, or retract. Unfortunately, these various gate arms are not always easily visible to the operators of vehicles. Nighttime, fog, distractions, misunderstandings of the gate arm itself and driver error all result in an accidental collision between a vehicle and a gate arm.

A variety of devices and methods have been utilized to minimize or prevent accidental collisions between the vehicle and a barrier gate arm. Reflective tape, bright colors, sound accompanying the pivoting of the gate arm and lighting have all been used to attract a driver's attention to prevent mishap. Of these, light systems are probably the most common accessory to a gate arm. The addition of light systems to barrier gate arms has significantly reduced the number of accidental collisions during nighttime.

As lighting systems for barrier gate arms have evolved, many gate arms now utilize lighting not only to enhance a barrier's visibility but also to provide additional information. For example, some barrier gate arms emit green light when the arm is retracted or pivoted out of a vehicle's way and emit red light when the arm is positioned to deny passage. Light systems now also may emit yellow lights or blinking lights as an arm transitions from one configuration to another. The signaling aspects of barrier gate arm lighting systems increases the importance of a vehicle operator's ability to accurately see a light system and correctly interpret the signal and information conveyed by the lighting system.

To minimize the amount of power required to pivot a gate arm when allowing access to a vehicle, it is often desirable to minimize the overall weight of a gate arm. Gate arms are often therefore constructed by extruding a lightweight material such as aluminum as a single piece. One method of minimizing the amount of material used is to integrate the structure of the light system housing with the outer casing or exterior wall of the gate arm. In the past, when gate arms were only designed to attract attention to their presence, this was a benefit. It allowed inexpensive reflective tape to reflect sunlight and make the gate arm more visible. Light systems generally have a protective casing that is also reflective and also reflects sunlight.

However, where light systems are now utilized to emit different colors as light signals, the reflection of sunlight can be confusing or detrimental. An observer can have difficulty determining whether an LED light strip is actually turned on and emitting light, or whether reflected sunlight is only producing a "phantom" light. Any signal intended to be conveyed by light color or flashing patterns can be difficult or impossible to determine in bright sunlight.

Thus, although the problem of gate arm visibility during the night has been well addressed, the new problem of correctly interpreting a gate arm's lighting signals in bright daylight has arisen as a new problem. Bright sunlight reflecting off the housing of a lighting system may often create the appearance of illumination when in fact an observer is seeing sunlight reflecting off a surface of a light system that is not illuminated. As a result, it can be very difficult to tell whether a lighting system of a gate arm is in fact self-illuminated in order to convey a "start" or "stop" signal, or is merely reflecting the sun.

When the now ubiquitous traffic signal lights were first introduced several decades ago, designers encountered this problem and added visors or sunshades to prevent sunlight from reflecting off of the traffic lights so that drivers could accurately identify the light signals being presented. However, such visors and shades are unwieldly, cumbersome and undesirable in barrier gate arms, which strive for simplicity, low weight and minimal cost of manufacture.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a barrier gate arm lighting system that reduces sunlight reflection off a light or light housing.

BRIEF SUMMARY OF THE INVENTION

Disclosed is an oblong gate arm having an outer casing comprised of an exterior wall, having an elongate channel extending longitudinally along its length, and a light housing recessed within the channel. A light strip is placed in the light housing and emits light which travels out of the channel and can be seen by an observer.

In one embodiment, a vehicle barrier gate system comprises an elongate gate arm defined by an exterior wall and having a length. An elongate visor channel extends along the length of the gate arm and is defined by an upper visor channel wall and an opposing parallel lower visor channel wall. The upper visor channel wall extends inward from an upper terminating end of the exterior wall and the lower visor channel wall extends inward from a lower terminating end of the exterior wall.

In another embodiment, an upper retaining fin extends perpendicularly from the upper channel wall into the channel. An opposing lower retaining fin extending perpendicularly from the lower channel wall into the channel. The upper retaining fin and the lower retaining fin are coplanar and define an aperture. The recessed light housing is medial to the visor channel and defined by the upper and lower retaining fins, the aperture and a backwall. The upper channel wall and the upper retaining fin meet at a right angle, thereby forming an upper crook in the upper corner of the visor channel. The lower channel wall and the lower retaining fin meet at a right angle, thereby forming a lower crook in the lower corner of the visor region. An LED light strip within the recessed light housing and emitting light through the aperture when the LED light strip is illuminated. A housing pivotally coupled to a proximal end of the gate arm, the housing having a control system and a power supply to selectively pivot the gate arm between a horizontal position and a vertical position. The gate arm is cylindrical or parallelepiped.

In another embodiment, a vehicle barrier gate system comprises an elongate gate arm having an exterior wall, a length, a first side and a second side. A first visor channel in the first side of the gate arm extends along the length of the gate arm. The first visor channel comprises a first upper visor channel wall and an opposing, parallel first lower visor channel wall. The first upper visor channel wall extends inward from a first upper terminating end of the exterior wall, and the first lower visor channel wall extends inward from a first lower terminating end of the exterior wall. A first upper retaining fin extends perpendicularly into the first visor channel from the first upper channel wall. A first lower retaining fin extends perpendicularly into the first visor channel from the first lower channel wall. The first lower retaining fin and the first upper retaining fin are parallel, coplanar and define a first aperture between them. A first recessed light housing at a medial end of the first visor channel is defined by the first upper retaining fin, the first lower retaining fin, and a first backwall medial to the first visor channel. The first upper channel wall and the first upper retaining fin meet at a right angle, thereby forming a first upper crook in the upper corner of the first visor channel.

The first lower channel wall and the first lower retaining fin meet at a right angle, thereby forming a first lower crook in the lower corner of the first visor region. A first LED light strip within the first recessed light housing and emits light through the first aperture when the first LED light strip is illuminated. A second visor channel in the second side of the gate arm extends along the length of the gate arm, the second visor channel comprises a second upper visor channel wall and an opposing, parallel second lower visor channel wall. The second upper visor channel wall extends inward from a second upper terminating end of the exterior wall, and the second lower visor channel wall extends inward from a second lower terminating end of the exterior wall. A second upper retaining fin extends perpendicularly into the second visor channel from the second upper channel wall. A second lower retaining fin extends perpendicularly into the second visor channel from the second lower channel wall. The second lower retaining fin and the second upper retaining fin are parallel, coplanar and define a second aperture between them. A second recessed light housing at a medial end of the visor channel is defined by the second upper retaining fin, the second lower retaining fin, and a second backwall medial to the second visor channel.

The second upper channel wall and the second upper retaining fin meet at a right angle, thereby forming a second upper crook in the upper corner of the second visor channel. The second lower channel wall and the second lower retaining fin meet at a right angle, thereby forming a second lower crook in the lower corner of the second visor region. A second LED light strip within the second recessed light housing emits light through the second aperture when the second LED light strip is illuminated. A housing pivotally coupled to a proximal end of the gate arm, the housing having a control system and a power supply to selectively pivot the gate arm between a horizontal position and a vertical position.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE SEVERAL VIEWS OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
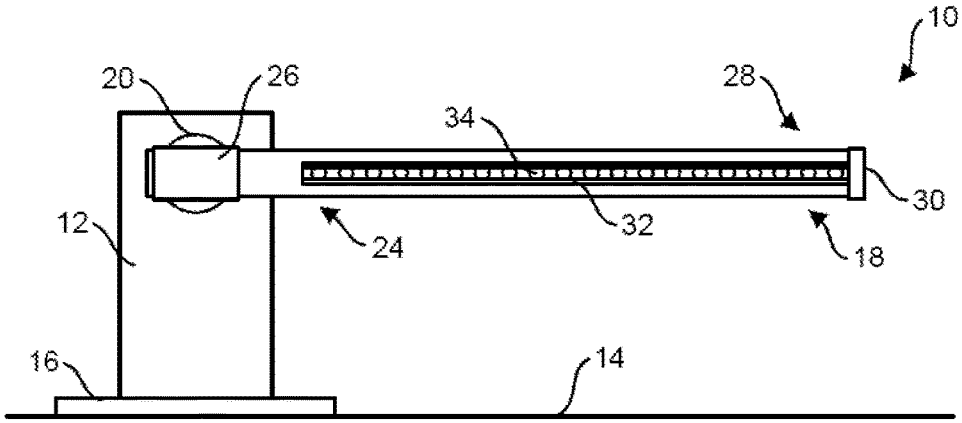
FIG. 1 is a front elevation view of a vehicle barrier system in accordance with principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

As used herein, the terms "medial" and "inward" refer generally to the center or middle of an object and the terms "lateral" and "outward" refer to the exterior of an object. For example, when referring to the gate arm, a component or structure is medial relative to another component if it is closer to internal center of the gate arm. Conversely, when a component or structure is referred to as lateral relative to another component, it is in a direction toward the outside or exterior of the gate arm. In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Disclosed is a barrier gate arm having a recessed light housing in accordance with principles of the invention. The barrier gate arm is an elongate structure such as the barrier gate arms commonly in use today. The gate arm has an exterior wall, or outer casing, that may be substantially hollow on the inside. The gate arm may also optionally have an internal framework or honeycomb. An elongate channel extends longitudinally along a substantial portion of the length of the exterior outer casing wall. A recessed light housing is positioned at the medial, or inward, end of the channel, and the channel itself acts as a sun visor, shielding the light strip from sunlight, thereby preventing "phantom" lighting due to sunlight reflection off the light system within the housing. A lighting device, such as an LED light strip, emits light through an aperture in the light housing at the medial end of the visor channel. Two retaining fins that extend into the visor channel from two opposing parallel visor channel walls. These retaining fins serve a dual function of both defining the lateral end of the light housing and forming crooks in the corners of the visor channel, where they form right angles between the visor channel walls and the retaining fins. These crooks are particularly darkly shaded regions in the upper and lower corners of the visor channel. The retaining fins also separate the light housing from the visor channel. Because the light housing is recessed inside the visor channel and is not flush with the exterior wall of the gate arm, the visor channel appears dark when the light system is not emitting any light. The dark appearance of the channel is accentuated by the crooks. When the light system is turned on its light is emitted through the aperture, the channel no longer appears dark, and the shaded crooks are not visible.

FIG. 1 shows a first embodiment of a barrier gate 10 in accordance with the principles of the invention. The barrier gate 10 includes a housing 12 affixed to a horizontal surface 14 at its base 16. The housing 12 contains a control system and an actuator for pivoting the gate arm 18. The housing 12 may have an internal or external power supply for powering the actuator and control system. In this embodiment, the horizontal surface 14 is the ground. A gate arm 18 is pivotally mounted to the housing by a pivoting bracket 20. The proximal region 24 of the gate arm 18 is inserted into a sleeve 26 that is attached to the bracket 20. The distal region 28 of the gate arm 18 has an end cap 30 removably affixed. An elongate channel 32 in the gate arm 18 extends longitudinally along a all or a substantial portion of the length of the gate arm 18. A light strip 34 is retained within a light housing inside the channel.

Figure 2:
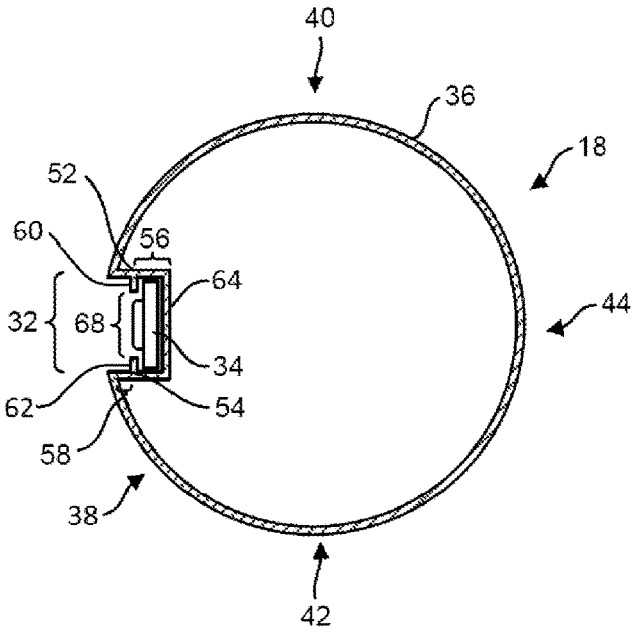
FIG. 2 is a cross-sectional view of a gate arm in accordance with the principles of the invention.

FIG. 2 shows a cross-section of the elongate gate arm 18 of the first embodiment in accordance with the principles of the invention. In this embodiment, the gate arm 18 is cylindrical, having a substantially circular cross-section. The shape of the gate arm 18 is defined by an exterior wall 36. Optionally, the gate arm 18 may have different cross-sectional geometries and may optionally include an internal frame or honeycomb. On a first side 38, a visor channel 32 extends along a substantial portion of the length of the gate arm 18. Because the gate arm 18 is cylindrical and thus radially symmetric, the first side 38 is distinguished from the top 40, bottom 42 and second side 44 only by orientation. Generally, the first side 38 and second side 44 refer to regions of the gate arm facing opposite horizontal directions. The top 40 refers to the region of the gate arm facing upward, while the bottom 42 refers to the region of the gate arm facing downward. The visor channel 32 could be positioned facing any direction by rotating the gate arm 18. Because the gate arm 18 is defined only by the geometry of the exterior wall 36, the exterior wall 36 may optionally be described as having a first side wall, a second side wall, a top member and a bottom member.

A recessed light housing 56 is positioned at the innermost part of the visor channel 32. The visor channel 32 of this embodiment is defined by a planar upper channel wall 52 and a planar lower channel wall 54. The upper channel wall 52 extends inward from the exterior wall 36 to a back wall 64. Similarly, the lower channel wall 54 also extends inward from the exterior wall 36 to the backwall 64. In this embodiment, the upper channel wall 52 and the lower channel wall 54 are planar, coextensive and parallel to one another. An upper retaining fin 60 extends into the visor channel 32 from the upper channel wall 52 and is perpendicular to the upper and lower channel walls 50 and 54. An opposing lower retaining fin 62 extends into the visor channel 32 from the lower channel wall 54, also perpendicular to the upper and lower channel walls 50 and 54. The upper and lower retaining fins 60 and 62 are coplanar, that is, they are aligned with each other. The upper and lower retaining fins 60 and 62 defines an aperture 68 opening into the visor channel 32 from the light strip housing 34. An LED light strip 34 is housed within the recessed light strip housing 56 and emits light through the aperture 68. The recessed light strip housing 56 is defined by the upper and lower retaining fins 60 and 62, the aperture 68 and a back wall 34.

Figure 3:
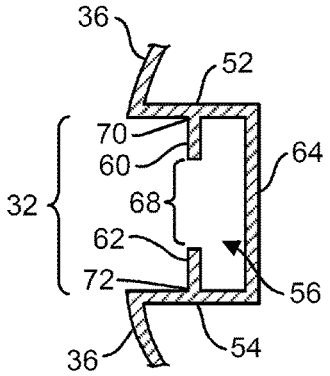
FIG. 3 is an enlarged cross-sectional view of a visor channel of a gate arm in accordance with the principles of the invention.

FIG. 3 shows the visor channel 32 in greater detail, with the LED light strip 34 removed for clarity. The upper channel wall 52 and the lower channel wall 54 are parallel and coextensive. In this embodiment, the backwall 64 is parallel to the aperture 68 and the retaining fins 60 and 62. In this embodiment, the light housing 56 has a rectangular cross-section. Light from the LED light strip is emitted through the aperture 68 and out of the opening 32 when the LED light strip is turned on.

The upper and lower visor channel walls 50 and 52 as well as the upper and lower retaining fins 62 and 60 have nonreflective surfaces. There are also no reflective or partially reflective materials within the visor channel 32. There are also no reflective or partially reflective objects between the upper and lower retaining fins 60 and 62. Those skilled in the art will appreciate that many light housings have a protective cover of plastic, glass or other transparent or semitransparent material extending over a light strip or light strip housing in order to prevent damage to the light strip. However, in accordance with principles of the invention, the region 58 of the visor channel 32, which extends from the upper and lower retaining fins 60 and 62 to the exterior wall 36, must not have reflective surfaces or be occupied by anything capable of reflecting outside light, thereby creating "phantom light." Phantom light can appear to an observer of the gate arm 18 to believe that a light strip within the light strip housing 56 is turned on when in fact the light strip is not illuminated.

To operate properly, the visor channel 32 must be empty. In other words, the visor channel 32 must not contain any material or objects capable of reflecting light out of the visor channel 32. Many types of light strips are encased in a transparent or semi transparent protective coating which may be capable of producing phantom light. The visor channel 32 minimizes this by shading the recessed light housing 56 and its aperture 68 from most light. Only light directly ahead and aligned with the visor channel 32 will be able to reflect off a light strip within the housing 56. Thus, although protective covers made of glass, plastic or the like are generally recommended and preferred in the art, they are excluded from gate arms and light housings as described in accordance with the principles of the present invention.

In this embodiment, the upper retaining fin 60 is at a right angle to the upper channel wall 52. This results in the formation of two inside corners, one of which is within the light housing 56. Inside corner, the upper channel crook 70, is located in the visor channel 32 between the upper retaining fin 60 and the upper channel wall 52. Similarly, the lower retaining fin 62 is at a right angle to the lower channel wall 54, forming an inside corner within the light housing 56 and a lower channel crook 72. Because crooks 70 and 72 are inside corners, they are particularly well shaded, even when a light source is almost directly head on to the visor channel 32. Therefore, when light is not emitted through the aperture 68, the channel will appear at least partially darkened to an observer, even in bright sunlight. When light is emitted through the aperture 68, the darkened crooks are not visible to an observer. The visor region 58 thereby substantially improves an observer's ability to determine whether or not the LED light strip is turned on and emitting light. In this embodiment, the upper and lower retaining fins 60 and 62 are coplanar and perpendicular to the visor channel walls 52 and 54. Optionally, the recessed retaining fins 60 and 62 may extend into the channel from their respective visor channel walls 52 and 54 angled slightly toward the exterior wall and opening into the channel. By angling the retaining fins 60 and 62 such that the upper channel crook 70 and lower channel crook 72 each form an acute angle, the upper and lower channel crooks 70 and 72 are even more shaded and shielded from light entering the visor channel 32.

Figure 4:
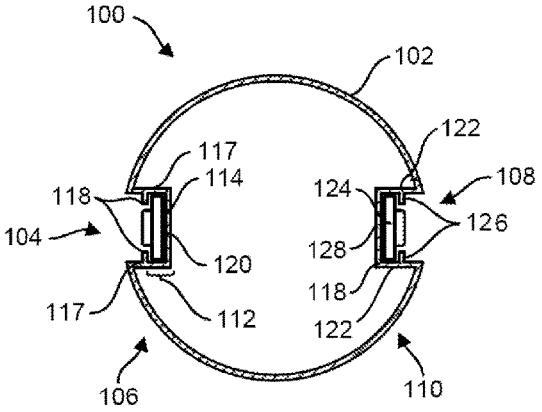
FIG. 4 is a cross-sectional view of an alternative embodiment of a gate arm in accordance with the principles of the invention.

FIG. 4 shows a cross-section of an alternative embodiment of a gate arm 100 having lighting systems on opposite sides 106 and 110. The gate arm 100 includes an exterior wall 102 having a first visor channel 104 on a first side 106 and a second visor channel 108 on a second side 110. The first visor channel 104 is defined by two parallel visor channel walls 117 extending from the exterior wall 102 to a first recessed light housing 112 containing a first LED light strip 114. The first recessed light housing 112 is defined by two opposing recessed retaining fins 118, the first visor channel walls 117 and a first back wall 120. Similarly, the second visor channel 108 on the second side 110 is defined by two parallel second visor channel walls 122 that extend from the exterior wall 102 to a second recessed light housing 118 containing a second LED light strip 124. The second recessed light housing 118 is also defined by two opposing recessed retaining fins 128 and a second back wall 128. As with the visor channel 32 of the first embodiment, the visor channels 104 and 108 are unoccupied and have no reflective surfaces.

Figure 5:
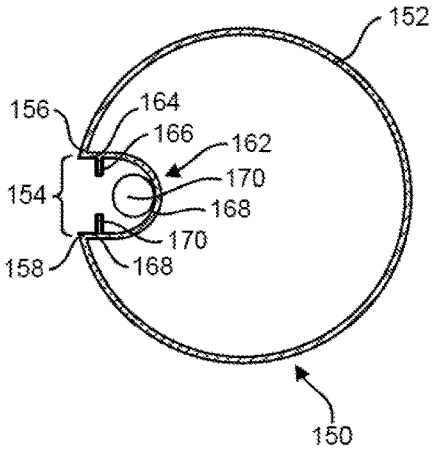
FIG. 5 is a cross-sectional view of another alternative embodiment of a gate arm in accordance with the principles of the invention.

FIG. 5 is a cross-section of another alternative embodiment of a gate arm 150 in accordance with the principles of the invention. This embodiment also includes an exterior wall 152 and a visor channel 154 defined by an upper visor channel wall 164 extending from an upper terminating end 156 to an upper retaining fin 166 and a lower channel wall 168 extending from a lower terminating end 158 to a lower retaining fin 170. In FIG. 5, the point where the upper visor channel wall 164 intersects with the exterior wall 150 is explicitly identified as the upper terminating end 156 of the exterior wall 150. Similarly, the point where the lower visor channel wall 168 intersects with the exterior wall 150 is explicitly identified as the lower terminating end 158. As used herein, the term "terminating end" generally refers to endpoints of the exterior wall 152 which define an opening in the exterior wall 152 defined by the upper visor channel wall 164 and the lower visor channel wall 168. Every embodiment of the invention inherently includes terminating ends defined as the locations where visor channel walls intersect exterior walls. The visor channel 154 has no reflective surfaces and is not occupied by any objects having reflective surfaces. The visor channel 154 has a recessed light housing 162 positioned at the innermost end of the visor channel 154, behind the retaining fins 166 and 170. The light housing 162 is defined by two retaining fins 164 and a curved back wall 168. In this embodiment, the recessed light housing 162 contains an LED light rope 170.

Figure 6:
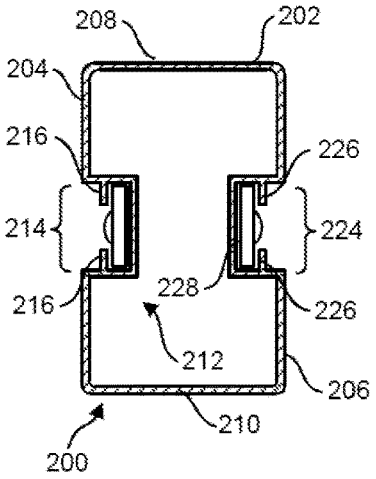
FIG. 6 is a cross-sectional view of another alternative embodiment of a gate arm in accordance with the principles of the invention.

FIG. 6 shows a cross-section of another alternative embodiment of a gate arm 200. The gate arm 200 has an orthogonal parallelepiped shape and a rectangular cross section defined by an exterior wall 202 having curved corners. Those skilled in the art will appreciate that gate arms may have many different geometries and therefore many different cross-sectional shapes. Generally, gate arms are cylindrical, parallelepiped or prismatic, and their sides are generally orthogonal. The external wall 202 has a first side 204 and a second side 206 separated by a top region 208 and a bottom region 210. The first side 204 has a first recessed light housing 212 at the innermost part of a first visor channel 214. The first recessed light housing 212 is separated from the first visor channel 214 by two opposing retaining fins 216 that define an aperture. The second side 206 has a second recessed light housing 228 at the innermost part of a second visor channel 224. The second recessed light housing 222 is separated from the second visor channel 224 by two opposing retaining fins 226 that define an aperture through which light emitted by the second LED light strip 228. Both visor channels 214 in 224 are not occupied by any objects having reflective surfaces in the visor channels themselves have no reflective surfaces.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A vehicle barrier gate system comprising;

an elongate gate arm defined by an exterior wall and having a length;

an opening in the exterior wall, the opening extending along the length of the gate arm and defined by an upper terminating end and a lower terminating end of the exterior wall;

an elongate channel extending along the length of the gate arm and defined by a planar upper channel wall extending inwardly from the upper terminating end of the exterior wall to a backwall and a planar lower channel wall extending inwardly from the lower terminating end of the exterior wall to the backwall, wherein the planar upper channel wall and the planar lower channel wall are parallel;

only a single recessed upper retaining fin extending perpendicularly from the planar upper channel wall into the channel, the recessed upper retaining fin being located between the upper terminating end and the backwall;

only a single recessed lower retaining fin extending perpendicularly from the planar lower channel wall into the channel, coplanar with and opposite to the upper retaining fin;

a visor channel defined by the upper and lower planar channel walls and extending from the upper and lower retaining fins to the terminating ends of the exterior wall;

a recessed light strip housing defined a region of the elongate channel between the backwall, the upper channel wall, the lower channel wall and the upper and lower retaining fins;

an aperture in the light housing between the coplanar upper and lower retaining fins;

wherein the upper retaining fin and the upper channel wall meet at a right angle, forming an upper crook between the upper retaining fin and the upper terminating end of the exterior wall;

wherein the lower retaining fin and the lower channel wall meet at a right angle, forming a lower crook between the lower retaining fin and the lower terminating end of the exterior wall;

an LED light strip located between the backwall and the upper and lower retaining fins within the recessed light strip housing, the LED light strip emitting light through the aperture between the upper and lower retaining fins; and, a housing pivotally coupled to a proximal end of the gate arm, the housing having a control system, a power supply and an actuator to selectively pivot the gate arm between a horizontal position and a vertical position;

wherein the visor channel is empty and has no reflective surfaces; and, wherein the exterior wall, the upper channel wall, the lower channel wall, the backwall, the upper retaining fin and the lower retaining fin all have an equal thickness.

2. The vehicle barrier gate system of claim 1 wherein the gate arm is cylindrical.

3. The vehicle barrier gate system of claim 1 wherein the gate arm is an orthogonal parallelepiped.

4. The vehicle barrier gate system of claim 1 wherein the backwall is parallel to the retaining fins.

5. The vehicle barrier gate system of claim 1 wherein the backwall is curved.

* * * * *